United States Patent [19]

Lamond et al.

[11] Patent Number: 4,835,524

[45] Date of Patent: May 30, 1989

[54] DEACTIVATABLE SECURITY TAG

[75] Inventors: Lee T. Lamond, North Wales, Pa.; Peter L. Gill, Long Valley, N.J.

[73] Assignee: Checkpoint System, Inc., Thorofare, N.J.

[21] Appl. No.: 134,467

[22] Filed: Dec. 17, 1987

[51] Int. Cl.[4] ..... G08B 13/14; H01Q 1/36

[52] U.S. Cl. ..... 340/572; 343/895

[58] Field of Search ..... 340/572; 343/895; 361/402

[56] References Cited

U.S. PATENT DOCUMENTS 3,967,161 6/1976 Lichtblau ..... 340/572 X 4,567,473 1/1986 Lichtblau ..... 340/572

4,689,636 8/1987 Tait et al. ..... 343/895

4,728,938 3/1988 Kaltner ..... 340/572

*Primary Examiner*—Glen R. Swann, III

*Assistant Examiner*—Thomas J. Mullen, Jr.

*Attorney, Agent, or Firm*—Alfred Stapler

[57] ABSTRACT

A resonant circuit which forms part of a security tag for use in an electronic security system includes a fusible link which opens the circuit in response to radio frequency at the resonant frequency. The fusible link opens at a lower signal intensity than otherwise, because the substances of which it is made include at least one accelerator that promotes the fuse action.

9 Claims, 1 Drawing Sheet

DEACTIVATABLE SECURITY TAG

FIELD OF THE INVENTION

The invention relates to a security device for use in detecting the unauthorized removal of articles, e.g. in retail establishments, and more particularly to a resonant circuit which is integrally formed as part of a tag or label for merchandise.

BACKGROUND OF THE INVENTION

The use of resonant circuits integrally formed as part of security tags and labels for theft prevention of retail goods is well known. Such security tags have been in commercial use for many years. These tag circuits are tuned to a given radio frequency, such that a detectable resonant condition will result. Should shoppers pass through the transmitting and receiving units at the portals of the store with these tags still attached to the merchandise, an alarm will sound.

It is current operating practice to remove these tags at the check-out counter, such that legitimate sales will proceed without sounding the alarm when the shopper exists the store.

It is also common practice to paste-over these circuits at the point of sale with a metallized sticker. These metallized paste-overs in effect prevent the resonant circuit from causing an alarm, thus allowing honest shoppers to pass safely through the exist.

While the aforementioned techniques have worked well in the marketplace, they nonetheless present certain drawbacks to the security system.

First, the need to remove these tags or to perform a paste-over, requires additional employee time and vigilance. The operating cost factor is increased as a result.

Secondly, this procedural step alerts would-be shoplifters to ways to defeat the detection system. Once cognizant of the process, shoplifters can themselves paste-over the security tags or labels, or remove them prior to leaving the store.

More recently, it has been suggested that the resonant tags be unobtrusively deactivated by electronic means. One such technique causes a "shorting" or "arcing" across the tuned circuit capacitor by means of an induced current, supplied by a radio frequency signal of higher energy than the detecting signal. This type of deactivating system is disclosed in U.S. Pat. No. 4,567,473, issued to George J. Lichtblau on Jan. 28, 1986.

Another electronic deactivation technique is disclosed in U.S. Pat. No. 3,967,161, issued to George J. Lichtblau on June 29, 1976. In this patent, a resonant circuit is shown having a fusible link, formed of a narrowed, or necked-down portion of the conductor that constitutes the inductor portion of the resonant circuit. This portion is caused to open by the relatively high intensity, induced current of the deactivating radio frequency signal.

While the aforesaid techniques perform the task of electronic deactivation in an adequate manner, they are not without certain weaknesses.

The fusible link technique requires a deactivating current which is so intense that the radio frequency signal needed to induce it can cause problems in conforming to the regulations and requirements of the Federal Communications Commission.

As for the capacitor shorting technique, this may not always provide a clean and definable short circuit across the resonant circuit, thus leaving the deactivation and disablement of the security tag in doubt.

BRIEF SUMMARY OF THE INVENTION

The invention features a tuned or resonant circuit tag or label, generally defined by at least one inductive and capacitive element arranged in series. These elements are deposited as thin conductive layers upon one or more substrates which function as dielectric insulator for the capacitive plate layers.

For the sake of brevity, the construction and function of these circuit tags is incorporated herein by way of reference to the prior art teachings, as disclosed in the aforementioned patents.

What is considered as one of the objectives of the present invention, is the providing of a technique and article by which the reliability and the facility of the deactivating process is improved.

In order to avoid potentially troublesome, high intensity radio frequency signals, the resonant circuit of this invention has been provided with a fusible link which is more sensitive to an induced current. This enhanced sensitivity allows the fuse to open more readily, and with a cleaner break in response to the deactivating signal.

The sensitivity of the fuse portion of the circuit is enhanced by the inclusion of at least one accelerator substance in the conductive fuse material. The accelerator substances can take several forms, such as being significantly exothermic in an electrochemical sense. An exothermic accelerator will cause a more rapid melting of the fuse material.

The accelerator substance can also comprise an explosive-type material, that will physically or mechanically destroy the fuse, when it is subjected to the influence of the induced current.

The fuse of this invention is generally fabricated by applying across a gap portion in the conductive path of the circuit a conductive material, such as carbon black, graphite, silver, copper, aluminum, gold, etc. The fuse material will fill the gap, thus completing the circuit, such that the circuit can then resonate in response to a radio frequency signal of given frequency.

The fuse material can be applied as an ink or coating upon the dielectric substrate that supports the conductive elements. For this purpose, silk screen, or any other suitable deposition processes can be employed. The conductive coating or ink fuse material is mixed with at least one accelerator substance, such as potassium permanganate, which acts as an explosive-type agent to mechanically assist the opening of the fuse. The potassium permanganate has catalytic properties which are also believed to assist in the melting and oxidative destruction of the conductive fuse material.

Other accelerator substances which are contemplated for use in this invention, but which are not considered as limiting or inclusive of the scope thereof, are potassium chlorate and perchlorate, potassium dichromate and potassium nitrate. Additional organic materials such as sugar will further enhance the conflagrant nature of these materials, as well as sulfur.

Of course, it is contemplated as part of this invention, to mix one or more of these substances with other accelerator materials, such as exothermic enhancers, in order to increase the reactive process.

Figure 1:
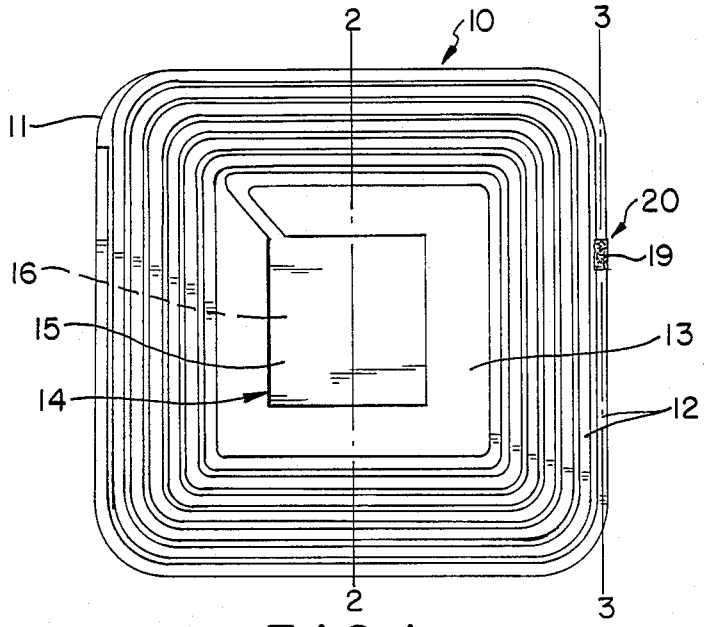
FIG. 1 shows a plan view of a typical resonant circuit tag of this invention, having a fuse portion embodying the invention.

The several views are not to scale; the overall dimensions of the complete tag 10 in FIG. 1 are typically in the neighborhood of 2×2 inches, or less.

The same reference numerals designate corresponding elements in the several figures.

DETAILED DESCRIPTION OF THE INVENTION

Generally speaking, the invention pertains to a circuit article for use in a security system. The system is designed to induce and detect a resonant condition in the circuit. The circuit is supported by a dielectric substrate. The circuit is defined by inductive and capacitive elements in series.

A fuse portion is disposed along a conductive path of the circuit and comprises both a conductive material and an accelerator substance. The fuse material is made more sensitive and fusible by virtue of the accelerator substance.

Now referring to FIG. 1, a resonant circuit article 10 is illustrated. The article 10 is designed as a tag or label that can be readily attached to merchantable goods. Article 10 comprises a thin, plastic substrate 11 upon which a conductive spiral strip 12 is deposited on surface 13. The spiral strip 12 functions as an inductor of the resonant circuit article 10, and may comprise an aluminum etch. The aluminum etched strip 12 may be approximately 0.030 inches wide and about 0.002 inches high.

Connected in series with the inductive strip 12 is a capacitor 14, which is fashioned from two conductive plates 15 and 16, respectively. These plates are deposited in the same manner as the inductive strip 12, and in the same process therewith.

Figure 2:
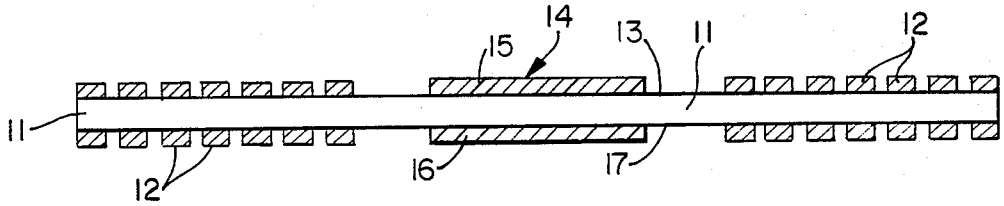
FIG. 2 shows a sectional view of the resonant circuit tag of FIG. 1, taken along lines 2—2.

Plate 15 is deposited on surface 13 of the substrate 11, and plate 16 is deposited on the reverse surface 17, as shown in the sectional view of FIG. 2. Although not visible in the drawings, there is also a conductive connection through the plastic substrate 11, between the end of spiral conductor 12 remote from capacitor plate 15 and capacitor plate 16 on the reverse side.

Figure 3:
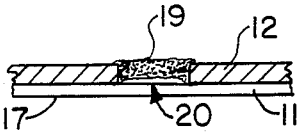
FIG. 3 shows a fragment of a sectional view of the resonant circuit tag of FIG. 1, taken along lines 3—3.

A gap 20 is fabricated in a portion of the conductive strip 12. The gap 20 may be approximately 0.05 inches in length. A fuse 19 is deposited across gap 20, by applying a conductive ink or coating to bridge gap 20, as can also be seen with reference to the sectional view of FIG. 3.

A suitable conductive ink for this purpose is a silver-containing ink made by Electro Science Laboratories, Incorporated, of King of Prussia, Pa. 19406, having formula designation 1112-S.

In accordance with the present invention, the ink or coating is made more readily fusible by the addition of an accelerator substance. A suitable accelerator substance has been found to be U.S.P. grade crystals of potassium permanganate, which are mixed with the aforesaid silver-containing ink in a volumetric ratio of one part potassium permanganate to approximately three parts ink.

The above admixture is thoroughly mixed and then applied across gap 20 using an 80 mesh silk screen.

The thickness of the fuse application may vary from approximately 0.015 to 0.125 inches.

The above coating is cured upon the substrate 11 by heating at a temperature of approximately 100° C., for approximately 20 minutes.

A suitable coating will dry with the potassium permanganate crystals in substantially uniform dispersion in the conductive ink base.

When a security tag 10 embodying the present invention is subjected to a radio-frequency signal at the resonant frequency of its resonant circuit, of relatively low intensity, but still sufficient to enable an electronic anti-shoplifting system to detect the tag's presence, then the fuse element 20 will remain unaffected, and the tag will remain capable of causing an alarm. On the other hand, when the tag 10 is subjected to a radio-frequency signal at the same frequency but of sufficiently increased intensity, by a deactivating unit provided for that purpose, then the fuse element 20 will react by opening, thereby interrupting the resonant circuit and rendering the tag incapable of causing an alarm. Due to the presence of an accelerator substance in the fuse material, in accordance with the present invention, the resultant deactivation of the security tag will occur at a substantially lower r-f signal intensity than in prior fuse-type security tags such as disclosed in the above-referenced U.S. Pat. No. 3,967,161. On the other hand, the deactivation will be more reliable than in prior shorting-type security tags such as disclosed in the above-referenced U.S. Pat. No. 4,567,473.

The equipment for producing the r-f signals discussed above may be of any one of various known forms and is therefore not described in further detail herein. For example, this equipment may be of the forms disclosed in the previously mentioned U.S. patents, or of the forms disclosed in U.S. patent application Ser. No. 817,843, filed Jan. 10, 1986, and assigned to the assignee of the present invention, now U.S. Pat. No. 4,728,938, issued Mar. 1, 1988.

Security tag 10 may be fabricated as an integral part of a tag or label for goods, so that it is easily attachable to merchandise prior to their sale. The tag or label can then be deactivated in accordance with the teachings of this invention at the point of sale, by casually passing the tag through the deactivating r-f signal field.

The potassium permanganate used in the fuse 19 provides an explosive-like function to mechanically destroy the conductive ink material. This insures that a clean and positive break is made across gap 20, thus disabling the circuit.

Although we do not wish to be bound by this explanation, it may be that the known catalytic properties of the potassium permanganate also contribute to the fuse action.

Other potassium salts which will provide accelerator functions are potassium chlorate, potassium perchlorate, potassium dichromate and potassium nitrate, to name a few. These substances can be further enhanced when organic materials are mixed therewith, such as sugar, carbon, etc.

Accelerators having high exothermic reactions will also be useful to open the conductive material deposited across gap 20.

For purposes of this invention, the use of any particular accelerator to enhance the sensitivity or the fusibility of the fuse materials is deemed exemplary, and is meant only to teach the skilled practitioner at least one means of practicing the invention.

One or several accelerators can be used, dependent upon good manufacturing techniques.

Likewise, any conductive coating, such as a conductive polymer, can be used as the fuse material. Some conductive substances suitable for this purpose are graphite, carbon black, silver, copper, aluminum and gold.

Having thus described the invention, what is desired to be protected by Letters Patent is defined in the appended claims.

We claim:

1. For use in an electronic security system in which radio frequency signals are transmitted and received and in which distortions of said received signals by the presence of a resonant circuit are detected, a security tag including such a resonant circuit, characterized in that said resonant circuit includes a fusible link portion comprising at least one substance which responds to current induced in said circuit by said transmitted signals to act as a circuit interrupting fuse and at least one other substance which promotes said fuse action, whereby said fuse action takes place at a lower induced current than in the absence of said other substance.

2. The security tag of claim 1, wherein said at least one other substance is exothermically reactive in response to an induced current of sufficient intensity.

3. The security tag of claim 1, wherein said at least one other substance is explosively reactive in response to an induced current of sufficient intensity.

4. The security tag of claim 3, wherein said other substance is potassium permanganate.

5. The security tag of claim 1, wherein said at least one other substance is electro-chemically reactive in response to an induced current of sufficient intensity.

6. The security tag of claim 1, wherein said circuit includes at least one capacitor and one inductor, said capacitor having plates disposed on opposite sides of a dielectric substrate, and said fusible link being connected in series with said inductor.

7. The security tag of claim 1, wherein said one substance is selected from the group of graphite, carbon, black, silver, copper, aluminum and gold.

8. The security tag of claim 1, wherein said other substance is selected from the group of potassium chlorate, potassium perchlorate, potassium dichromate and potassium nitrate.

9. The security tag of claim 1, wherein said substances are present in the form of a mixture.

* * * * *